US011336064B2

(12) United States Patent
Miyazaki

(10) Patent No.: US 11,336,064 B2
(45) Date of Patent: May 17, 2022

(54) ELECTRICAL CONNECTOR ASSEMBLY AND ELECTRONIC DEVICE COMPRISING SAME

(71) Applicant: Hirose Electric Co., Ltd., Yokohama (JP)

(72) Inventor: Atsuhiro Miyazaki, Yokohama (JP)

(73) Assignee: Hirose Electric Co., Ltd., Kanagawa (JP)

( * ) Notice: Subject to any disclaimer, the term of this patent is extended or adjusted under 35 U.S.C. 154(b) by 0 days.

(21) Appl. No.: 16/987,858

(22) Filed: Aug. 7, 2020

(65) Prior Publication Data

US 2021/0044064 A1 Feb. 11, 2021

(30) Foreign Application Priority Data

Aug. 9, 2019 (JP) ..... JP2019-146954

(51) Int. Cl.

| | |
|---|---|
| ***H01R 24/40*** | (2011.01) |
| ***H01R 13/631*** | (2006.01) |
| ***H01R 13/639*** | (2006.01) |
| *H01R 103/00* | (2006.01) |

(52) U.S. Cl.

CPC ..... *H01R 24/40* (2013.01); *H01R 13/631* (2013.01); *H01R 13/639* (2013.01); *H01R 2103/00* (2013.01)

(58) Field of Classification Search

CPC ..... H01R 24/40; H01R 13/631; H01R 13/639
See application file for complete search history.

(56) References Cited

U.S. PATENT DOCUMENTS 1,166,087 A * 12/1915 Schmidt ..... H01R 4/4845 439/786
2,834,884 A * 5/1958 Domenichini ..... H03D 9/0616 455/330
4,544,225 A * 10/1985 Raus ..... H01R 13/639 439/296
4,871,323 A * 10/1989 Ohsumi ..... H01R 13/639 439/188

(Continued)

FOREIGN PATENT DOCUMENTS

JP 2602483 B2 1/1997

*Primary Examiner* — Neil Abrams
(74) *Attorney, Agent, or Firm* — Procopio, Cory, Hargreaves & Savitch LLP

(57) ABSTRACT

An electrical connector assembly has a first connector, to which a cable is connected, a second connector, which is mounted to a mounting face of a support member and into/from which the first connector is inserted/removed, and an intermediate member that prevents disengagement of the first connector from the second connector. The intermediate member has a mountable portion mounted directly, or mounted indirectly through an intermediary member, to the second connector, and a locking portion that prevents upward disengagement of the first connector, and, while the mountable portion is mounted to the second connector, the intermediate member is enabled for operational movement relative to the second connector between an open position that allows for the insertion/removal of the first connector into or from the second connector and a locked position in which disengagement of the first connector is prevented by the locking portion.

15 Claims, 12 Drawing Sheets

(56) References Cited

U.S. PATENT DOCUMENTS

| | | | | |
|---|---|---|---|---|
| 5,013,258 | A * | 5/1991 | Schaef | F21V 19/0005 439/233 |
| 5,637,009 | A * | 6/1997 | Tsuji | H01R 13/639 439/347 |
| 7,520,764 | B2 * | 4/2009 | Lee | H01R 13/62911 439/153 |
| 8,333,623 | B2 * | 12/2012 | Nickel | H01R 13/639 439/859 |
| 10,050,400 | B2 * | 8/2018 | Eckel | H01R 4/48 |
| 10,158,200 | B2 * | 12/2018 | Miyazaki | H01R 12/75 |
| 10,374,361 | B1 * | 8/2019 | Lien | H01R 24/68 |
| 10,826,235 | B2 * | 11/2020 | Shain | H04N 5/232 |
| 2021/0044064 | A1 * | 2/2021 | Miyazaki | H01R 13/631 |

* cited by examiner

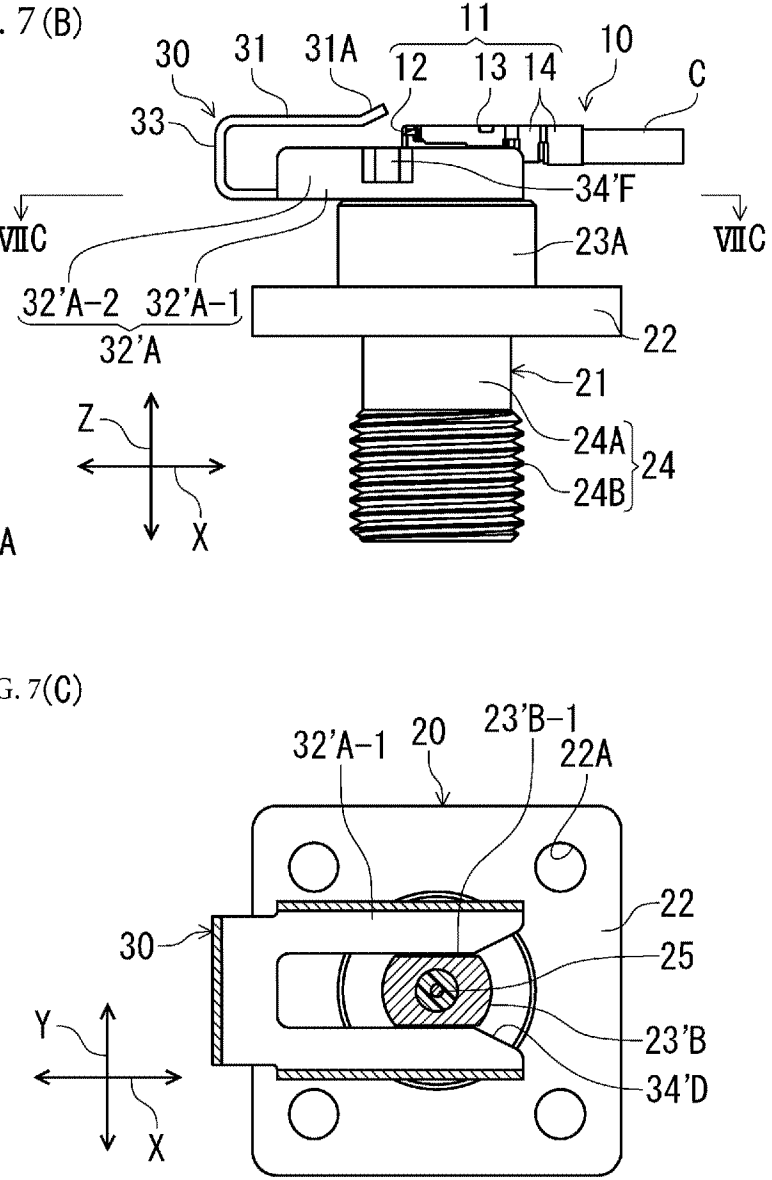
FIG. 7(B)
FIG. 7(C)
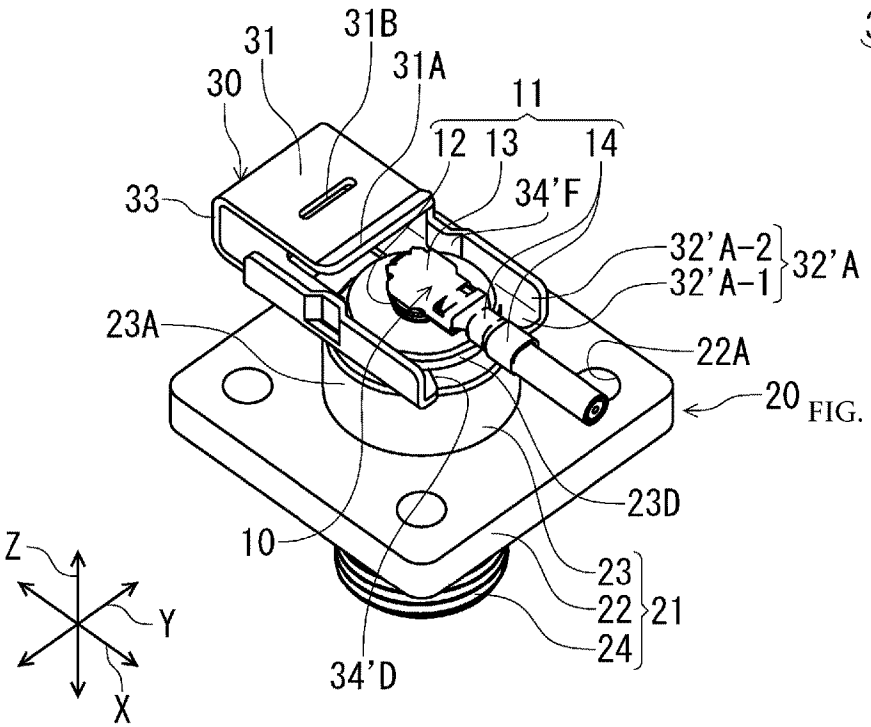
FIG. 7(A)

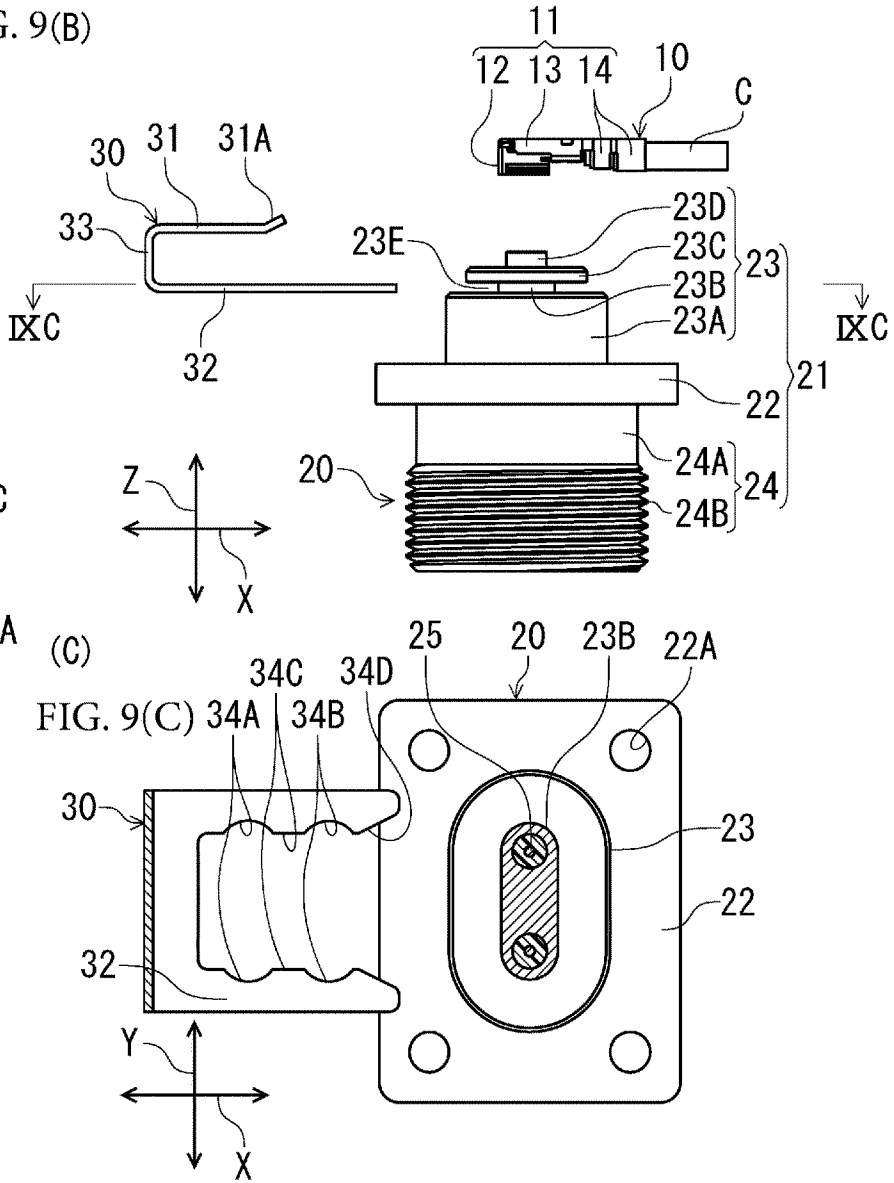
FIG. 9(B)
FIG. 9(C)
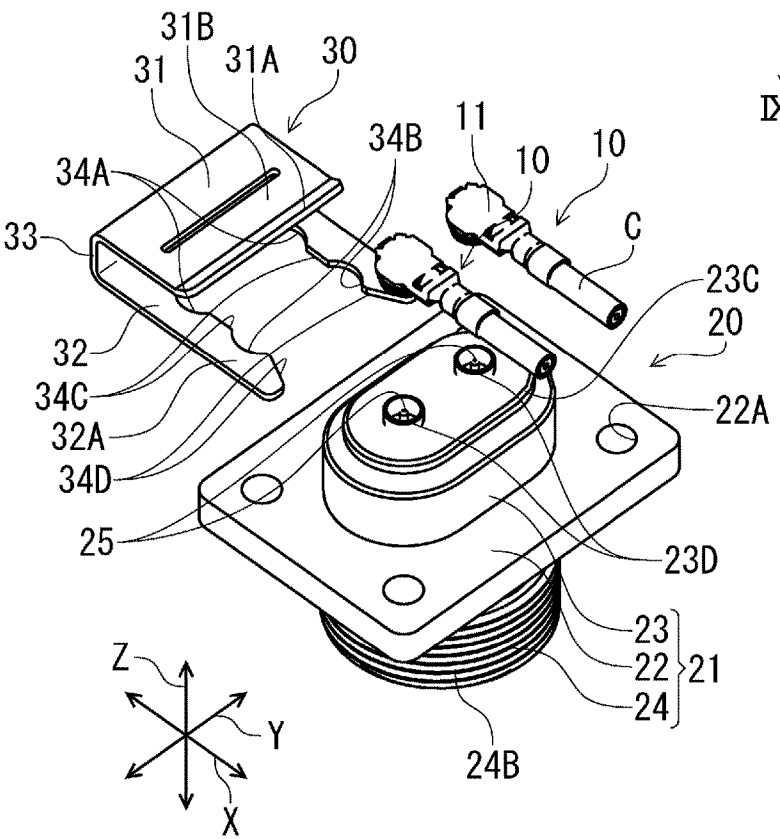
FIG. 9(A)

ELECTRICAL CONNECTOR ASSEMBLY AND ELECTRONIC DEVICE COMPRISING SAME

BACKGROUND

Cross-Reference to Related Applications

This application claims priority to Japanese Patent Application No. 2019-146954, filed Aug. 9, 2019, the contents of which are incorporated herein by reference in its entirety for all purposes.

Technical Field

The present invention relates to an electrical connector assembly, which is an electrical connector assembly having a first connector and a second connector and which includes an intermediate member that prevents inadvertent mutual disengagement of the connectors, and to an electronic device comprising the same.

Related Art

This type of electrical connector assembly is known to have been disclosed, for example, in Patent Reference 1. Along with having a socket connector (receptacle connector), which is mounted to a housing of an electrical device, etc., and a cable-equipped plug connector, the electrical connector assembly described in Patent Reference 1 includes an intermediate member ("connector position assurance means" in Patent Reference 1) that engages the socket connector and the plug connector such that inadvertent detachment of the plug connector from the socket connector is prevented once the plug connector is mated with the socket connector.

The plug connector, which has a substantially rectangular parallelepiped-like exterior configuration where the direction of mating with the socket connector is the thickness direction of the connector and the other two directions perpendicular thereto are the forward-backward direction and the connector width direction, has a rearwardly extending cable connected thereto. The intermediate member is adapted to be plugged into said plug connector from the front towards the rear of said plug connector. Projections ("latch bosses" in Patent Reference 1) that engage the hereinafter-described intermediate member are provided on the top and lateral faces of the plug connector.

The intermediate member, which has a substantially square tubular configuration formed by a top wall, lateral walls, and a partial bottom wall extending in the forward-backward direction and is shaped such that its interior tubular surface is in a face-to-face relationship with the exterior surface of the plug connector, has an open rear portion on the side plugged into the plug connector in the forward-backward direction and a sealed front portion. Furthermore, an intermediate section of said intermediate member in the connector width direction, which is located in the bottom portion proximate the socket connector, is cut out, and partial bottom walls are left on both lateral edges in the connector width direction. A narrow slot extending rearwardly from the front end to the vicinity of the rear end, which is formed in the top wall as well as in the lateral walls of the intermediate member, is guided by the above-described projection of the plug connector while engaging said projection with the front end of the slot to define the forward-most position of the intermediate member.

The socket connector has is a cylindrical portion whose axis is oriented in the direction of mating of the connectors. Said cylindrical portion is seated in a retaining hole formed in the housing and is positioned with respect to the housing so that outward disengagement from said housing is made impossible. A pair of flanges ("projections" in Patent Reference 1) are provided protruding from the exterior surface of the housing at the distal end of the cylindrical portion located in the opening of the retaining hole. Said pair of flanges protrude radially outwardly in the connector width direction in the form of wings.

When the electrical connector assembly is formed, first, the intermediate member is plugged into the plug connector from the front end side towards the rear end side of said plug connector. After the plug connector is mated with the socket connector while the intermediate member is partially plugged therein to a certain depth only ("preliminarily mounted" in Patent Reference 1), the intermediate member, guided by the projection of the plug connector in the slot of said intermediate member, is plugged in further by moving rearwardly along the exterior surface of the plug connector and is positioned at a location wherein the front edge of the slot, upon abutting the projection, has undergone elastic deformation and has ridden over said projection. In addition, forward disengagement of the intermediate member is prevented. As the intermediate member is plugged into the plug connector, the partial bottom walls on both lateral edges of the intermediate member enter between the underside of the flanges of the socket connector and the exterior surface of the housing, thereby preventing upward movement of the intermediate member and, in turn, that of the plug connector into which the intermediate member is plugged. In other words, once the plug connector has been mated with the socket connector, disengagement of the plug connector is prevented.

PATENT REFERENCES

[Patent Reference 1]
Japanese Patent No. 2,602,483

SUMMARY

Problems to be Solved

In the aforedescribed Patent Reference 1, an intermediate member is partially externally fitted onto the plug connector and mounted to the plug connector in unstable state when the plug connector is mated with the socket connector.

Since the cable connected to the plug connector is long and flexible, during operations involving manually picking up and mating the plug connector with the socket connector, the cable as well as the unstable intermediate member add a degree of difficulty to the operations. In addition, once the intermediate member is mounted to the plug connector, the operator's view of the socket connector is correspondingly obstructed and the operations become even more difficult to accomplish because said intermediate member is larger than the plug connector in the connector width direction.

With these circumstances in mind, it is an object of the present invention to provide an electrical connector assembly and an electronic device including the same, in which, prior to mating a first connector, such as a plug connector, with a second connector, such as a socket connector, an intermediate member that prevents the disengagement of the first connector is mounted to the second connector in advance, and, during the operation of mating the first connector, said operation can be accomplished with ease without obstructing the view of the socket connector. It is an object of the present invention to provide an electrical connector assembly including an intermediate member that facilitates the operation of insertion/removal of a first connector into/from a second connector and reliably prevents disengagement of the first connector, as well as an electronic device having the same.

Technical Solution

The inventive electrical connector assembly has a first connector, to which a cable is connected, a second connector, which is mounted to a mounting face of a support member and into/from which the first connector is inserted/removed, and an intermediate member that prevents the first connector from disengaging from the second connector, and the up-down direction perpendicular to the mounting face is used as the insertion/removal direction of the first and second connectors.

In the aforedescribed electrical connector assembly according to the present invention, the intermediate member is characterized by having the following first or second configuration.

<First Configuration>

The intermediate member has a mountable portion mounted directly, or mounted indirectly through an intermediary member, to the second connector, and a locking portion that prevents upward disengagement of the first connector, and is characterized by the fact that, upon connection of the first connector to the second connector, the intermediate member is mounted via the mountable portion to the second connector at a locked position in which disengagement of the first connector is prevented by the locking portion.

<Second Configuration>

The intermediate member has a mountable portion mounted directly, or mounted indirectly through an intermediary member, to the second connector, and a locking portion that prevents upward disengagement of the first connector, and is characterized by the fact that, while the mountable portion is mounted to the second connector, the intermediate member is enabled for operational movement relative to the second connector between an open position that allows for the insertion/removal of the first connector into/from the second connector and a locked position in which disengagement of the first connector is prevented by the locking portion.

In the first configuration, the intermediate member, upon connection of the first connector to the second connector, is mounted to the second connector and prevents disengagement of the first connector at the locked position.

In the second configuration, prior to connection by plugging the first connector into the second connector, the intermediate member is mounted to the second connector with the help of the mountable portion of said intermediate member and is maintained at the open position. At said open position, the intermediate member presents no obstacles whatsoever to the plugging of the first connector into the second connector. In this state, the first connector is connected to the second connector, whereupon the intermediate member is maneuvered to the locked position. When the intermediate member is at the locked position, the locking portion of said intermediate member prevents disengagement of the first connector and the first connector cannot be disengaged unless said intermediate member is intentionally returned to the open position. To disengage the first connector, the intermediate member is returned to the open position.

In this manner, while no special explanation is required in the case of the first configuration, in the second configuration, the first connector can also be plugged into the second connector while the intermediate member is mounted to the second connector at the open position and there is no conventional intermediate member mounted to the first connector during the connecting operation, as a result of which the operator's view is not obstructed by the intermediate member during the operation of plugging the first connector into the second connector and the plugging operation is accomplished in a simple and reliable manner.

In the second configuration of the present invention, the intermediate member has a bottom portion, which forms the mountable portion, and a top portion, which forms the locking portion. One end of the bottom portion and one end of the top portion are coupled by a coupling portion, with the top and bottom portions extending towards the other ends in the direction of operational movement of the intermediate member. At the open position, the top portion can be configured to form an insertion/removal space that permits the insertion/removal of the first connector.

In such a case, when the intermediate member is at the open position, an insertion/removal space that allows for the insertion/removal of the first connector is formed at the top portion of said intermediate member.

If the intermediate member is shaped such that the ends of the top and bottom portion on one side thereof are coupled by a coupling portion, the insertion/removal space of the intermediate member can be adapted to be formed by making the top portion shorter than the bottom portion in the direction of operational movement. Both shape and fabrication are simplified in such a configuration since merely making the top portion of the intermediate member shorter than its bottom portion is sufficient.

In the second configuration of the present invention, the mountable portion of the intermediate member has two arm portions extending in the direction of operational movement, the second connector has a mounting groove wherein the arm portions of the mountable portion of the intermediate member are mounted to the second connector by moving in the direction of operational movement, and said mounting groove, while making the operational movement of the intermediate member possible, allows the arm portions to engage the second connector in the up-down direction within the mounting groove. The mounting groove makes the operational movement of the intermediate member possible, and, at the same time, said mounting groove engages the arm portions of the intermediate member in the up-down direction, thereby precluding disengagement of said intermediate member in the up-down direction.

In this manner, in the configuration wherein two arm portions are provided in the mountable portion of the intermediate member and a mounting groove is formed in the second connector, the mutually opposed inner edges of the two arm portions extend in a rectilinear manner in the direction of operational movement, the mounting groove has an interior groove surface extending in a rectilinear manner in the direction of operational movement along the inner edges of the arm portions, and the inner edges of the arm portions can be adapted to abut the interior groove surface of the mounting groove.

In such a configuration, the inner edges of the arm portions and the interior groove surface of the mounting groove can abut in a plane extending in a rectilinear manner in the direction of operational movement and inadvertent rotation of the first connector about an axis oriented in the insertion/removal direction is restricted.

In the present invention, when the intermediate member has two arm portions serving as a mountable portion, the two arm portions preferably have engaging portions for positioning in the direction of operational movement by engaging the second connector either at the open position or at the locked position. When the arm portions have engaging portions, engagement of the second connector by said engaging portions reliably positions the intermediate member either at the open position or at the locked position, and the insertion/removal of the first connector can be performed in a stable manner.

In the first and second configuration of the present invention, the intermediate member is preferably made from a curved metal sheet member. When it is made from a curved metal sheet, the intermediate member is easier to fabricate, has thinner walls in comparison with a member made of plastic, and has a more compact geometry, which not only facilitates handling, but also avoids impairing the operator's view during insertion/removal of the first connector.

In the first and second configuration of the present invention, a connector formed such that the cable extends in a direction parallel to the mounting face can be used as the first connector. It is called a right-angle connector. In such a case, the cable connected to the first connector can be adapted to extend from the first connector from one end towards the other end of the intermediate member.

The present invention is applicable to cases in which the cable is a coaxial cable, and the first and second connectors are coaxial connectors.

Furthermore, the present invention is applicable to an electronic device comprising an electrical connector assembly of the above-described first or second configuration and a support member having the second connector of said electrical connector assembly mounted thereto directly or through an intermediary member, wherein said support member is a circuit board or a housing provided in the electrical device.

Technical Effect

In accordance with the first configuration of the present invention as described above, in a connector assembly having a first connector, to which a cable is connected, a second connector, which is mounted to a mounting face of a support member and into/from which the first connector is inserted/removed, and an intermediate member that prevents the first connector from disengaging from the second connector, the intermediate member has a mountable portion mounted directly, or mounted indirectly through an intermediary member, to the second connector, and a locking portion that prevents upward disengagement of the first connector, and, upon connection of the first connector to the second connector, the intermediate member is mounted via the mountable portion to the second connector at a locked position in which disengagement of the first connector is prevented by the locking portion, as a result of which the intermediate member, upon connection of the first connector to the second connector, is mounted to the second connector and prevents disengagement of the first connector at the locked position.

In addition, in the second configuration, the intermediate member has a mountable portion mounted to the second connector and a locking portion that prevents upward disengagement of the first connector, and, while the mountable portion is mounted to the second connector, the intermediate member is enabled for sliding movement relative to the second connector between an open position that allows for the insertion/removal of the first connector into/from the second connector and a locked position in which disengagement of the first connector is prevented by the locking portion, as a result of which, prior to mating the first connector with the second connector, the intermediate member that prevents the disengagement of the first connector is mounted to the second connector in advance, and, during the operation of mating the first connector, since the intermediate member is not present in the first connector, the operation can be accomplished with ease without obstructing the view with respect to the second connector.

BRIEF DESCRIPTION OF DRAWINGS

FIGS. 1(A) to 1(C) are illustrations in which a plug connector serving as a first connector, a receptacle connector serving as a second connector, and a locking slider serving as an intermediate member in a first embodiment are in a separated state, wherein FIG. 1(A) is a perspective view, FIG. 1(B) is a lateral view, and FIG. 1(C) is an IC cross-section view taken at the location of the mounting groove of the receptacle connector.

FIGS. 2(A) to 2(C) are illustrations in which the locking slider is at the open position in the first embodiment, wherein FIG. 2(A) is a perspective view, FIG. 2(B) is a lateral view, and FIG. 2(C) is an IIC cross-section view taken at the location of the mounting groove of the receptacle connector.

FIGS. 3(A) to 3(C) are illustrations in which the plug connector is connected to the receptacle connector when the locking slider is at the open position in the first embodiment, wherein FIG. 3(A) is a perspective view, FIG. 3(B) is a lateral view, and FIG. 3(C) is a IIIC cross-section view taken at the location of the mounting groove of the receptacle connector.

FIGS. 4(A) to 4(C) are illustrations in which the locking slider is at the locked position in the first embodiment, wherein FIG. 4(A) is a perspective view, FIG. 4(B) is a lateral view, and FIG. 4(C) is an IVC cross-section view taken at the location of the mounting groove of the receptacle connector.

FIGS. 5(A) to 5(C) are illustrations in which a plug connector serving as a first connector, a receptacle connector serving as a second connector, and a locking slider serving as an intermediate member in a second embodiment are in a separated state, wherein FIG. 5(A) is a perspective view, FIG. 5(B) a lateral view, and FIG. 5(C) is a VC cross-section view taken at the location of the mounting groove of the receptacle connector.

FIGS. 6(A) to 6(C) are illustrations in which the locking slider is at the open position in the second embodiment, wherein FIG. 6(A) is a perspective view, FIG. 6(B) is a lateral view, and FIG. 6(C) is a VIC cross-section view taken at the location of the mounting groove of the receptacle connector.

FIGS. 7(A) to 7(C) are illustrations in which the plug connector is connected to the receptacle connector when the locking slider is at the open position in the second embodiment, wherein FIG. 7(A) is a perspective view, FIG. 7(B) is a lateral view, and FIG. 7(C) is a VIIC cross-section view taken at the location of the mounting groove of the receptacle connector.

FIGS. 8(A) to 8(C) are illustrations in which the locking slider is at the locked position in the second embodiment, wherein FIG. 8(A) is a perspective view, FIG. 8(B) is a lateral view, and FIG. 8(C) is a VIIIC cross-section view taken at the location of the mounting groove of the receptacle connector.

FIGS. 9(A) to 9(C) are illustrations in which a plug connector serving as a first connector, a receptacle connector serving as a second connector, and a locking slider serving as an intermediate member in a third embodiment are in a separated state, wherein FIG. 9(A) is a perspective view, FIG. 9(B) is a lateral view, and FIG. 9(C) is an IXC cross-section view taken at the location of the mounting groove of the receptacle connector.

FIGS. 10(A) to 10(C) are illustrations in which the locking slider is at the open position in the third embodiment, wherein FIG. 10(A) is a perspective view, FIG. 10(B) is a lateral view, and FIG. 10(C) is an XC cross-section view taken at the location of the mounting groove of the receptacle connector.

FIGS. 11(A) to 11(C) are illustrations in which the plug connector is connected to the receptacle connector when the locking slider is at the open position in the third embodiment, wherein FIG. 11(A) is a perspective view, FIG. 11(B) is a lateral view, and FIG. 11(C) is an XIC cross-section view taken at the location of the mounting groove of the receptacle connector.

FIGS. 12(A) to 12(C) are illustrations in which the locking slider serving as the intermediate member is at the locked position in the third embodiment, wherein FIG. 12(A) is a perspective view, FIG. 12(B) a lateral view, and FIG. 12(C) is an XIIC cross-section view taken at the location of the mounting groove of the receptacle connector.

DETAILED DESCRIPTION

Embodiments of this invention will be discussed below with reference to the accompanying drawings.

First Embodiment

A connector assembly according to a first embodiment of the present invention is illustrated in FIGS. 1(A) to 4(C). FIGS. 1(A) to 4(C) show a first connector, a second connector, and an intermediate member successively transitioning from a separated state to a state wherein the intermediate member has been moved to the locked position after mating the first connector with the second connector. In the figures, FIGS. 1(A), 2(A), 3(A) and 4(A) illustrate perspective views, FIGS. 1(B), 2(B), 3(B), and 4(B) illustrate lateral views, and FIGS. 1(C), 2(C), 3(C), and 4(C) illustrate cross-section views taken at the location of the mounting groove of the receptacle connector serving as the second connector.

Figure 1B:
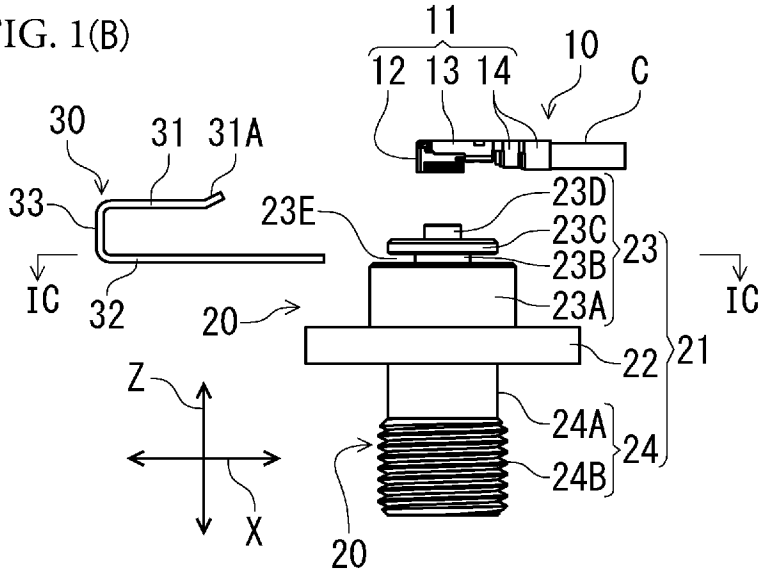
Figure 1C:
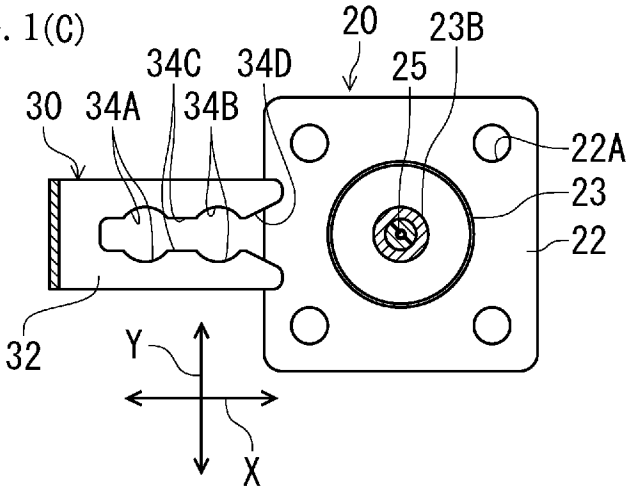
Figure 1A:
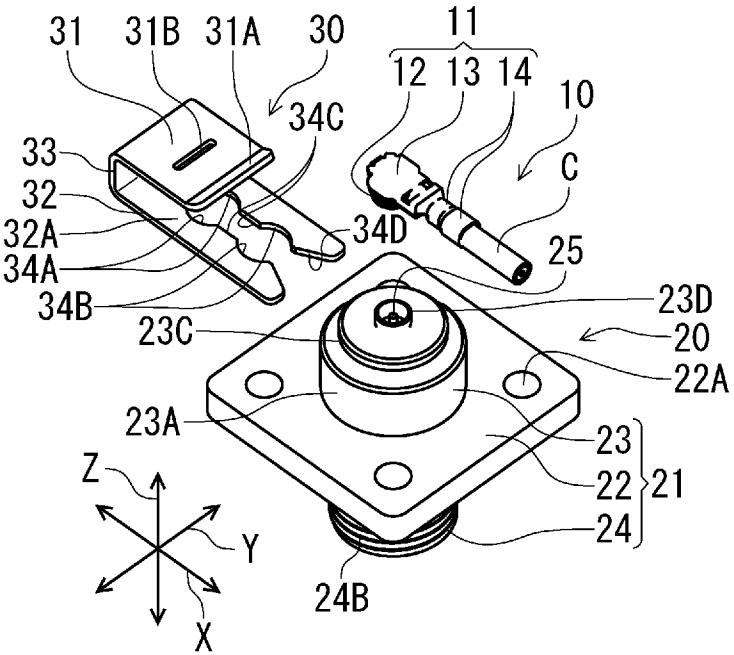
Figure 2B:
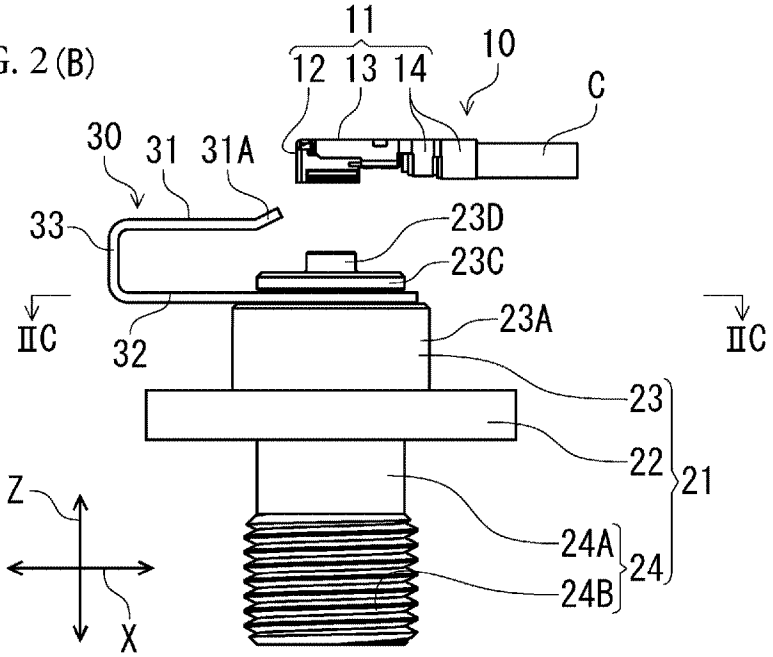
Figure 2C:
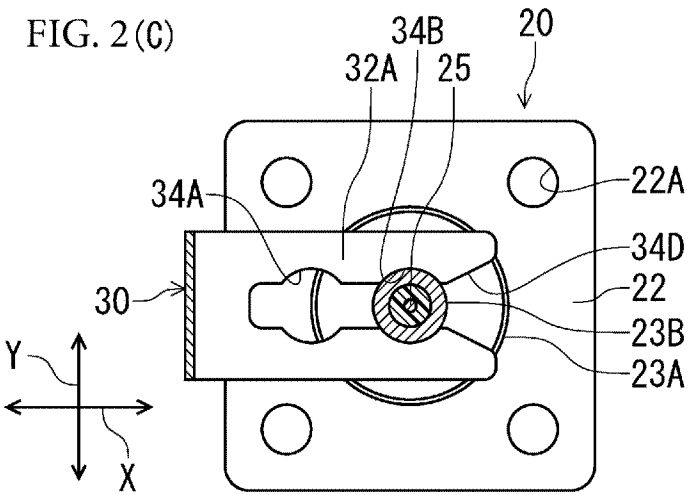
Figure 2A:
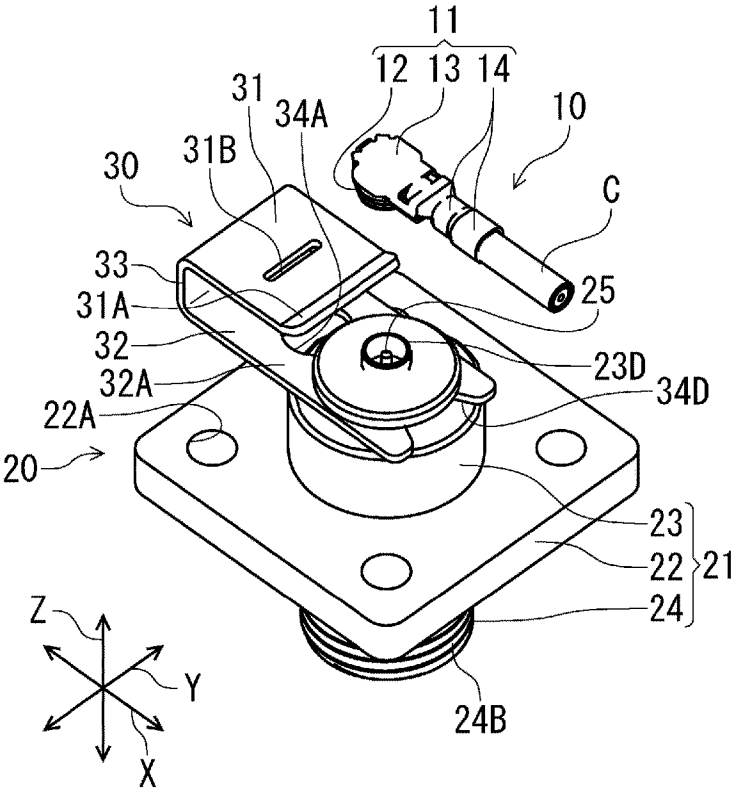
Figure 3B:
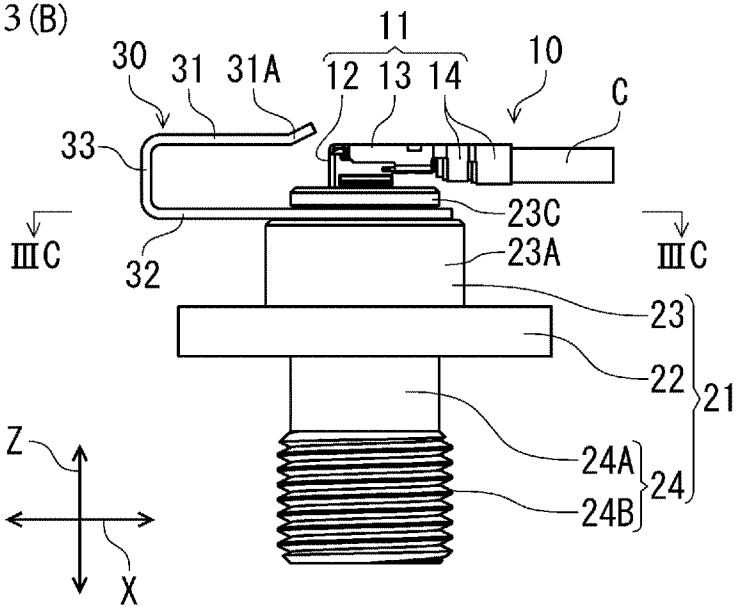
Figure 3C:
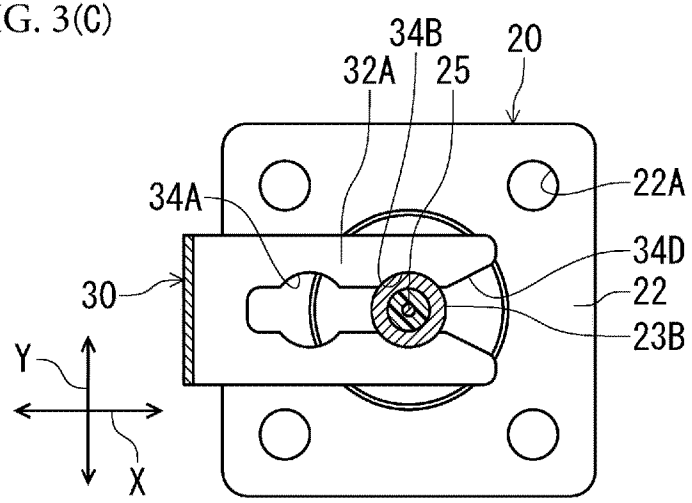
Figure 3A:
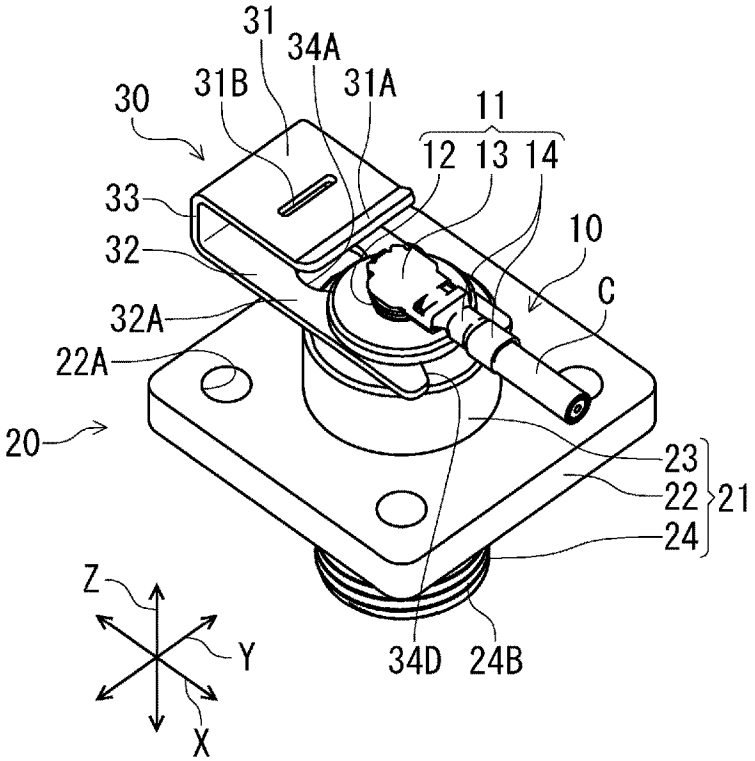
Figure 4B:
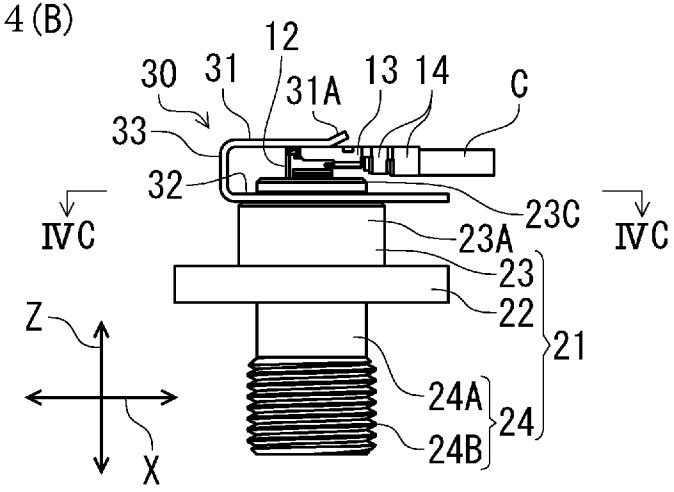
Figure 4C:
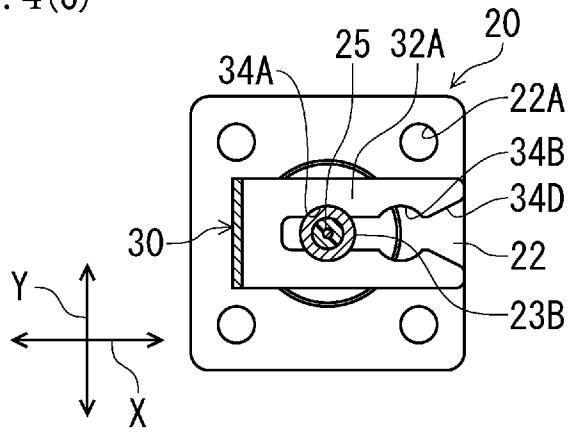
Figure 4A:
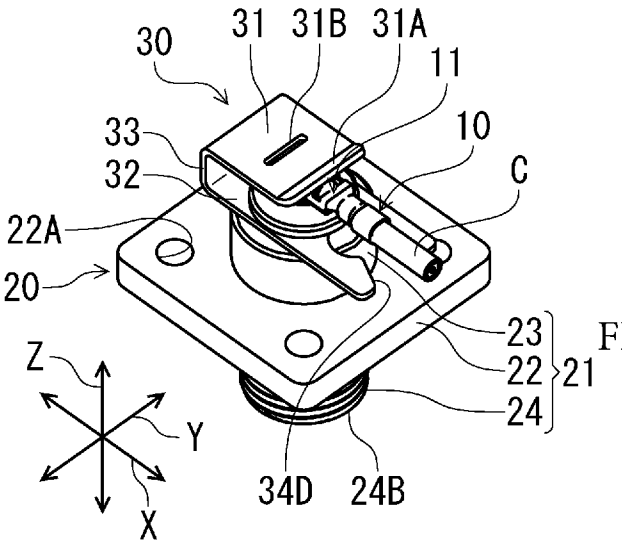

In FIGS. 1(A) to 1(C), a plug connector 10 serving as a first connector, a receptacle connector 20 serving as a second connector, and a locking slider 30 serving as an intermediate member are shown in a separated state. For purposes of orientation, in FIGS. 1(A) to 1(C), the direction in which the cable C connected to the plug connector 10 extends is defined as the forward-backward direction X, the direction in which the plug connector 10 is matingly inserted into and removed from the receptacle connector 20 perpendicularly to the forward-backward direction is defined as the insertion/removal direction Z, and the direction perpendicular to both the forward-backward direction X and the insertion/removal direction Z is defined as the connector width direction Y.

The plug connector 10 is a coaxial connector. Its outer conductor 11 includes a cylindrical mating body portion 12 whose axis is oriented in the insertion/removal direction Z, a cover portion 13 located on the side farthest from the receptacle connector 20 in the insertion/removal direction Z, and a cable retaining portion 14 extending from the cover portion 13 toward one side in the forward-backward direction X (rearwardly to the right). The mating body portion 12, cover portion 13, and cable retaining portion 14 are formed as a single piece by bending a metal sheet. Within the mating body portion 12, a metal shaft-like inner conductor (not shown), surrounded by a dielectric body of insulating material (not shown), is supported to extend in the insertion/removal direction Z.

In the cable C connected to the plug connector 10, which is a coaxial cable, a metal core wire is disposed within the dielectric body of insulating material, a shield wire is provided around the periphery of the dielectric body, and, furthermore, a covering of insulating material is provided on the outer periphery thereof (the core wire and the dielectric body are inside the covering and are not shown in FIGS. 1(A) to 1(C)). The core wire is connected to the inner conductor of the plug connector 10. In addition, with the shield wire exposed at one end of the covering and brought into contact with the cable retaining portion 14 of the outer conductor 11 of the plug connector 10, the cable C is secured in place by the cable retaining portion 14 as a result of the clamping action of this cable retaining portion 14 in the exposed section of the shield wire and the covering section. Further detailed description of the plug connector 10 is omitted because the internal structure of the plug connector 10 is not a distinguishing feature of the present invention.

In FIGS. 1(A) and 1(B), the receptacle connector 20, which is located under the plug connector 10 in the insertion/removal direction Z, is a coaxial connector and has a metal outer conductor 21. Said outer conductor 21 includes a flange portion 22 in the shape of a rectangular plate parallel to a plane that includes the forward-backward direction X and the connector width direction Y, a cylindrical upper body portion 23 located above said flange portion 22 and having its axis oriented in the insertion/removal direction Z, and a lower body portion 24 located under the flange portion 22 and having its axis in the same position as the upper body portion 23. The flange portion 22, upper body portion 23, and lower body portion 24 are fabricated as a single piece by forming metal stock.

Mounting holes 22A used for mounting the flange portion 22 to a circuit board, housing, or another support member in the electronic device (not shown) by inserting screws, etc., therethrough, are formed in the four corners of said flange portion 22.

As can be best seen in FIG. 1(B), the upper body portion 23 includes a cylindrical upper base portion 23A proximate the flange portion 22, an intermediate portion 23B which protrudes from the top end of said upper base portion 23A and has a smaller diameter than said upper base portion 23A, an annular protrusion 23C which is located at the top end of said intermediate portion 23B and has a larger diameter than said intermediate portion 23B, and a mating portion 23D which protrudes from said annular protrusion 23C and has a smaller diameter than the intermediate portion 23B. A mounting groove 23E constituting an annular recess, into which the mountable portion of the hereinafter-described locking slider 30 is inserted, is formed between the bottom face of the annular protrusion 23C and the top face of the intermediate portion 23B. The width of said mounting groove 23E (distance between the top face of the intermediate portion 23B and the annular protrusion 23C) is slightly larger than the thickness of the mountable portion of the hereinafter-described locking slider 30.

The mating portion 23D is a section onto which the mating body portion 12 of the outer conductor 11 of the plug connector 10 is externally fitted from above.

The lower body portion 24 located under the flange portion 22 includes a cylindrical lower base portion 24A proximate the flange portion 22, and a connecting portion 24B which is located under said lower base portion 24A and has formed thereon an external thread with a slightly larger diameter than said lower base portion 24A. Said connecting portion 24B is provided to allow another coaxial counterpart connector (not shown) connected to the receptacle connector 20 to be threadedly connected thereto.

In its interior, the aforedescribed receptacle connector 20 is provided with a pin-shaped inner conductor 25 (see FIG. 1(C)) that extends between the top and bottom ends thereof (in other words, between the top end of the mating portion 23D and the bottom end of the connecting portion 24B), said inner conductor 25 being held in place by a dielectric body 26 (see FIG. 1(C)) interposed between said inner conductor 25 and the outer conductor 21. Said mating portion 23D has no dielectric body present and has an annular space (not shown) formed proximate its top end opening. A corresponding female-type inner conductor (not shown) of the plug connector 10 enters this annular space and comes into contact with the inner conductor 25. In addition, the exterior peripheral surface of the mating portion 23D comes into contact with the interior surface of the mating body portion 12 of the outer conductor 21 of the plug connector 10.

The locking slider 30 serving as an intermediate member, which is fabricated by bending a metal sheet and whose cross-section has a recumbent U-shaped configuration, as can be seen in FIG. 1(B), includes a top portion 31 serving as a locking portion, which is located proximate the plug connector 10 in the insertion/removal direction Z and prevents disengagement of the plug connector 10, a bottom portion 32 serving as a mountable portion, which is located proximate the receptacle connector 20 and is mounted to the receptacle connector 20, and a coupling portion 33, which couples the ends of the top portion 31 and the bottom portion 32 on one side thereof (on the left in FIG. 1(B)).

The top portion 31 and the bottom portion 32, which have a planar shape plane including the forward-backward direction X and the connector width direction Y, that is, in a plane substantially parallel to the major faces of the flange portion 22 of the receptacle connector 20, are in face-to-face relationship at an upper and lower location in the insertion/removal direction Z. This locking slider 30 is mounted via the bottom portion 32 of said locking slider 30 to the mounting groove 23E of the receptacle connector 20, enabling movement in the forward-backward direction X. In this mounted state, the bottom portion 32 can select the mounting location by moving between an open position on the front side (on the left in FIGS. 1(A) to 1(C)) and a locked position on the rear side (on the right in FIGS. (A) to 1(C)). At the open position, with the bottom portion 32 of the locking slider 30 supported by the mounting groove 23E, its top portion 31 does not reach the location of the mating portion 23D of the receptacle connector 20, and the locking slider 30 leaves the space above the mating portion 23D open. At this open position, the plug connector 10 is enabled for mated connection to the mating portion 23D of the receptacle connector 20. As the bottom portion 32 of the locking slider 30 moves rearwardly and arrives at the locked position, the top portion 31 of said locking slider 30 ends up positioned above the mating portion 23D.

The distance between the top portion 31 and the bottom portion 32 of the locking slider 30, in other words, the length (height) of the coupling portion 33 in the insertion/removal direction Z, is configured such that when the locking slider 30 is at the locked position, the top portion 31 of said locking slider 30 is in a face-to-face relationship, or in surface contact with, the top face of the plug connector 10 connected to the mating portion 23D.

As described above, length in the forward-backward direction X is configured to be shorter than the bottom portion 32 such that the top portion 31 of the locking slider 30 arrives at the location of the top face of the plug connector 10 when the locking slider 30 is at the locked position and leaves the space above the mating portion 23D open when the locking slider 30 is at the open position. The rear end edge of the top portion 31 is adapted to have formed therein a ramped edge 31A facing slightly upward so as to make it possible to easily move onto the top face of the plug connector 10 as the locking slider 30 travels toward the locked position. In addition, a viewing window 31B is formed in this top portion 31 to permit checking the state of the plug connector 10 from above when the locking slider 30 is at the locked position.

The bottom portion 32 of the locking slider 30 has a pair of arm portions 32A rearwardly extending from the location of the coupling portion 33. Arcuate concave front engaging portions 34A and rear engaging portions 34B are formed at two locations in the forward-backward direction X on the opposite inner edges of said arm portions 32A, and narrowing portions 34C, which narrow the distance between the opposite inner edges, are formed in the forward-backward direction X between the front engaging portions 34A and the rear engaging portions 34B. Lead-in portions 34D sloping so as to gradually expand the distance between the opposite inner edges are formed on the rear end side. The narrowing portions 34C are sized to be urged against the outer diameter surface of the intermediate portion 23B constituting the bottom of the mounting groove 23E and widen the distance between the opposite inner edges to accommodate the outer diameter surface of said intermediate portion 23B upon entry into the mounting groove 23E of the receptacle connector 20. The front engaging portions 34A and rear engaging portions 34B are sized to be urged against and engage the outer diameter surface of the intermediate portion 23B.

Practical use of the aforedescribed electrical connector assembly according to the first embodiment will be discussed below.

First, the receptacle connector 20 is mounted to a mounting face of a circuit board or a housing serving as a support member (not shown) in the electronic device. Such mounting is accomplished by disposing the flange portion 22 of the receptacle connector 20 on the mounting face and by inserting mounting screws, etc., through the mounting holes 22A formed in the flange portion 22 to secure it to the mounting face. Next, the receptacle connector 20 is connected by threadedly engaging another coaxial connector (not shown) mounted to a coaxial cable wired within the electronic device with the connecting portion 24B of the receptacle connector 20. This makes it possible to connect the plug connector 10 to the receptacle connector 20.

Next, prior to connection of the plug connector 10 to the receptacle connector 20, the locking slider 30 is mounted to said receptacle connector 20. The locking slider 30 is introduced via the lead-in portions 34D located on the rear end side, i.e., the open side, of the pair of arm portions 32A provided in the bottom portion 32 thereof into the mounting groove 23E whose bottom is constituted by the exterior peripheral surface of the intermediate portion 23B of the receptacle connector 20, the spacing between the lead-in portions 34D mutually opposed at the location where said lead-in portions 34D are closest to the rear engaging portions 34B is widened, and the rear engaging portions 34B engage the exterior peripheral surface of the intermediate portion 23B, thereby maintaining the locking slider 30 at the open position illustrated in FIGS. 2(A) to 2(C). With the locking slider 30 maintained at the open position, the top portion 31 of the locking slider 30 does not reach the location of the mating portion 23D of the receptacle connector 20 in the forward-backward direction X and leaves the space above the mating portion 23D open, thereby forming an insertion/removal space that permits the insertion/removal of the plug connector 10 into/from the mating portion 23D.

Next, with the locking slider 30 mounted to the receptacle connector 20 in the mounting groove 23E of the receptacle connector 20 at the open position, the plug connector 10 is matingly connected to the mating portion 23D from above in the insertion/removal space above the mating portion 23D of the receptacle connector 20 (see FIGS. 3 (A) to 3 (C)). At this point, the plug connector 10 is electrically coupled through the medium of the receptacle connector 20 to another coaxial connector connected to said receptacle connector 20 within the electronic device.

Next, with the plug connector 10 connected to the receptacle connector 20, the locking slider 30 is maneuvered rearwardly from the open position to the locked position. As the narrowing portions 34C of the pair of arm portions 32A of the locking slider 30 are widened by being urged against the exterior peripheral surface of the intermediate portion 23B of the receptacle connector 20, the locking slider 30 moves rearwardly, and the front engaging portions 34A of the arm portions 32A reach the location of the intermediate portion 23B, whereupon the front engaging portions 34A engage the intermediate portion 23B such that the locking slider 30 is brought to the locked position and its position is maintained (see FIGS. 4(A) to 4(C)). At this locked position, the top portion 31 of the locking slider 30 is located on the top face of the plug connector 10, preventing disengagement of said plug connector 10. Should the degree of mating of the plug connector 10 with the receptacle connector 20 be insufficient, reliable mating may be achieved as the top portion 31 of the locking slider 30 applies downward pressure to the top face of the plug connector 10. At the aforesaid locked position, the connection status of the plug connector 10 can be confirmed through the viewing window 31B of the locking slider 30.

Second Embodiment

A connector assembly used in a second embodiment of the present invention is shown in FIGS. 5(A) to 8(C). FIGS. 5(A) to 8(C) show a plug connector serving as a first connector, a receptacle connector serving as a second connector, and a locking slider serving as an intermediate member successively transitioning from a separated state to a state wherein the locking slider has been moved to the locked position after mating the plug connector with the receptacle connector, and in each of the figures, FIGS. 5(A), 6(A), 7(A), and 8(A) are perspective views, FIGS. 5(B), 6(B), 7(B), and 8(B) are lateral views, and FIGS. 5(C), 6(C), 7(C), and 8(C) are cross-section views taken at the location of the mounting groove of the receptacle connector, which is similar to the first embodiment illustrated in FIGS. 1(A) to 4(C). It is to be noted that in FIGS. 5(A) to 8(C), which illustrate the second embodiment, parts in common with FIGS. 1(A) to 4(C), which illustrate the first embodiment, are designated with like reference numerals and their discussion is omitted.

Figure 5B:
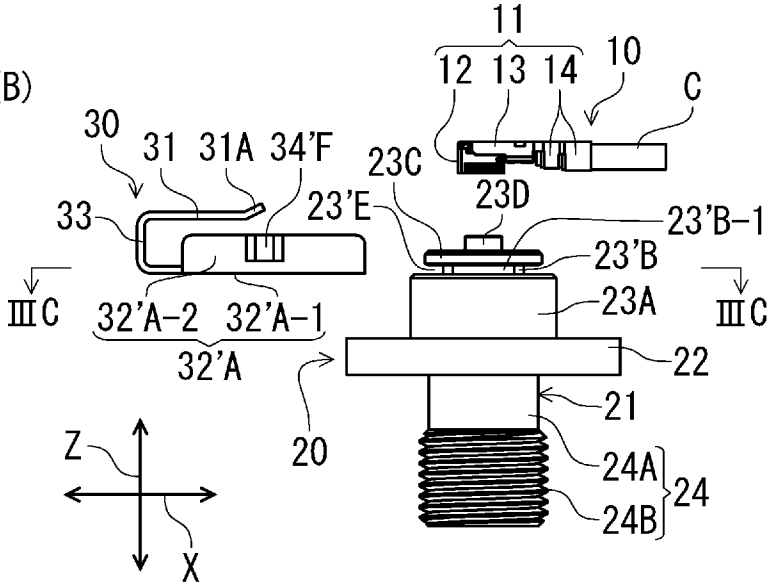
Figure 5C:
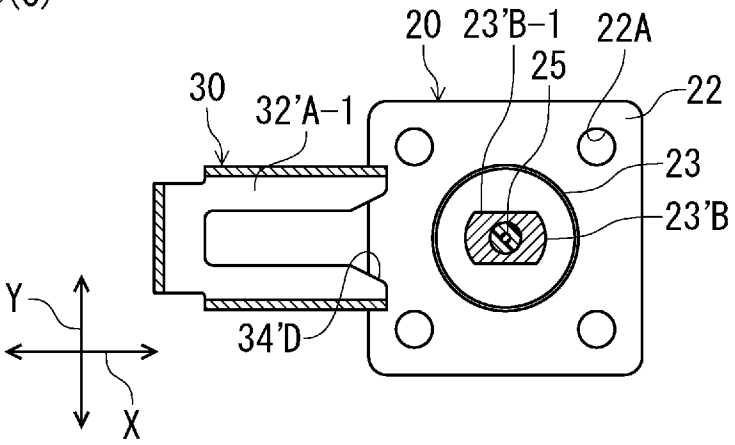
Figure 5A:
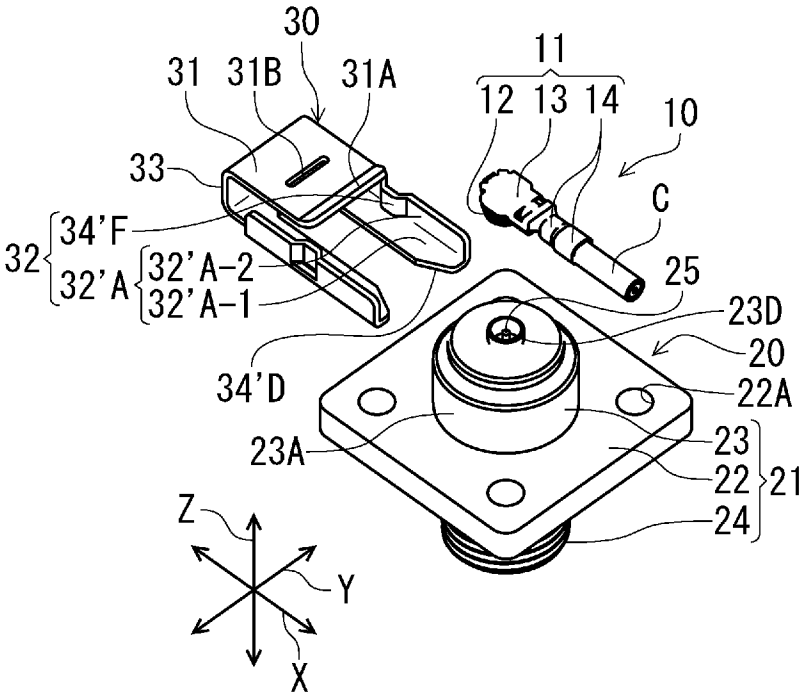
Figure 6B:
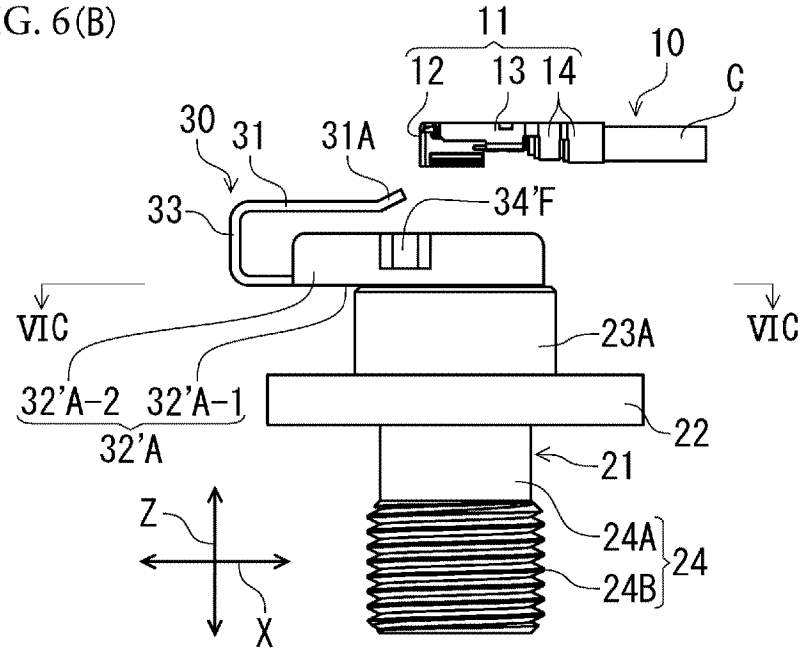
Figure 6C:
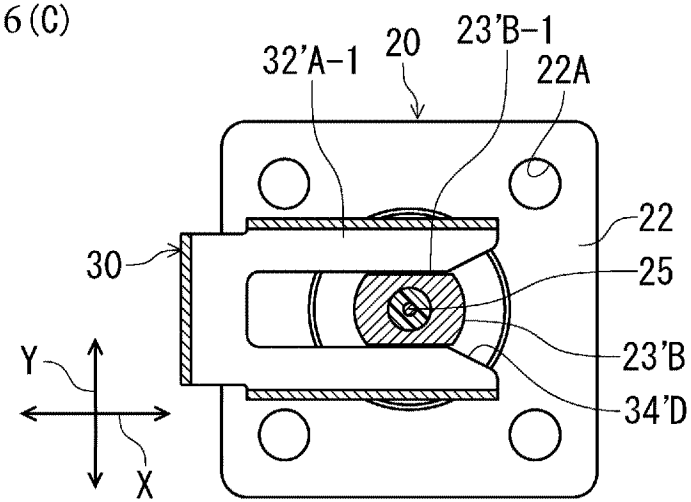
Figure 6A:
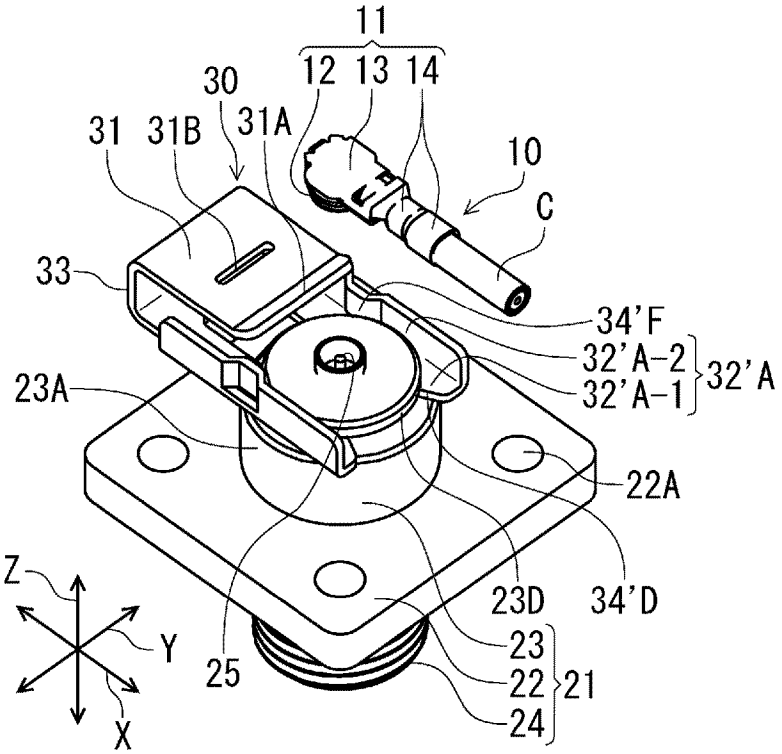
Figure 8B:
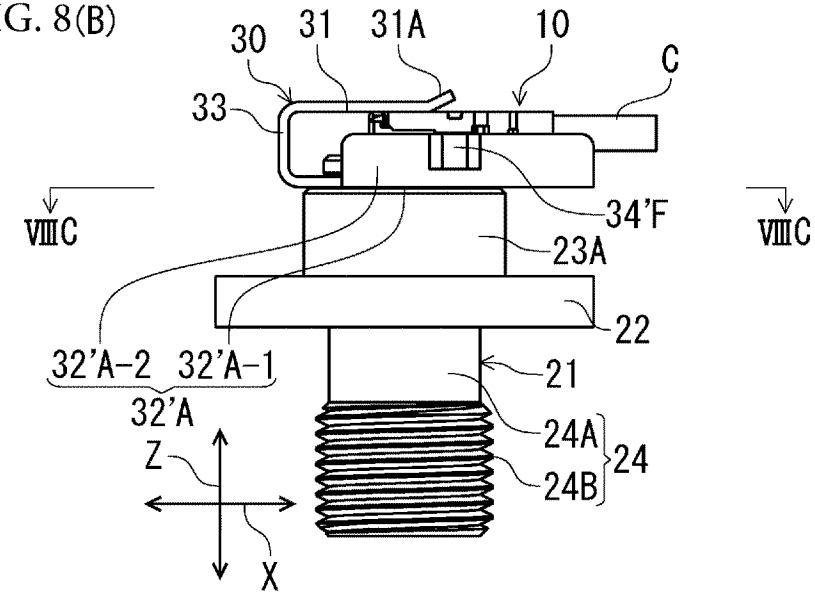
Figure 8C:
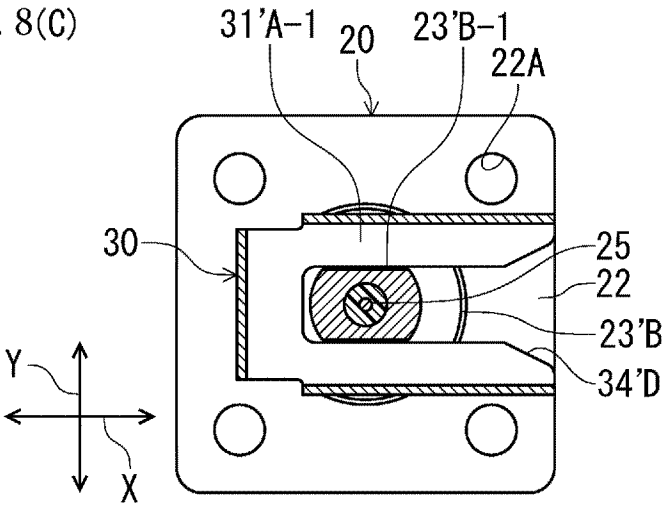
Figure 8A:
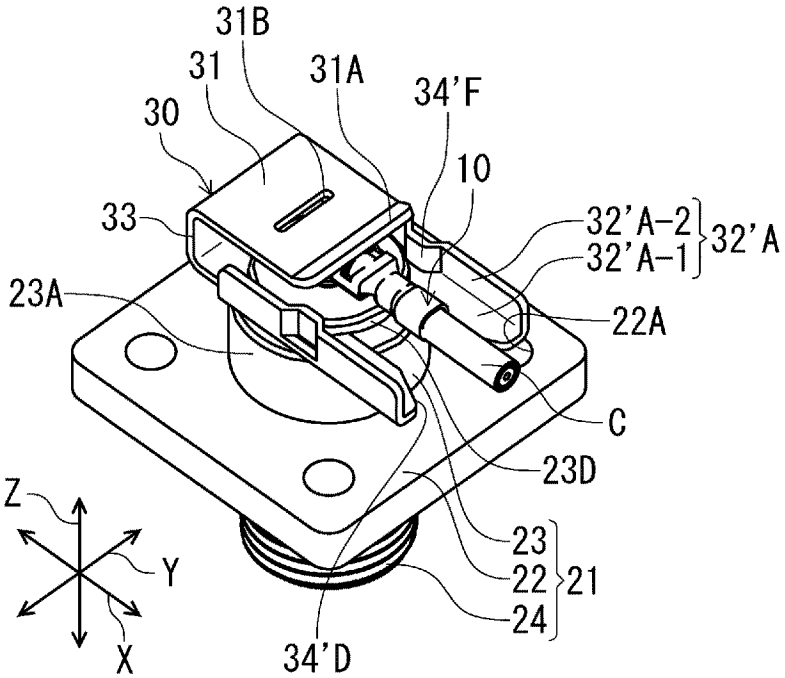
Figure 10B:
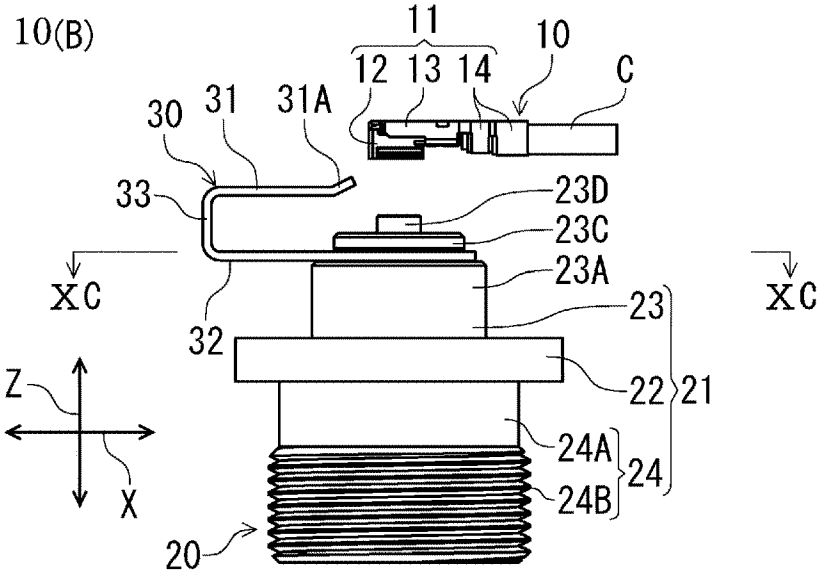
Figure 10C:
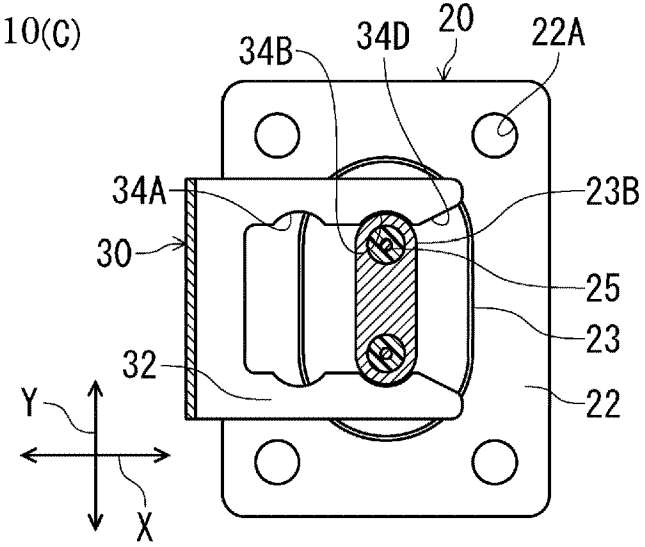
Figure 10A:
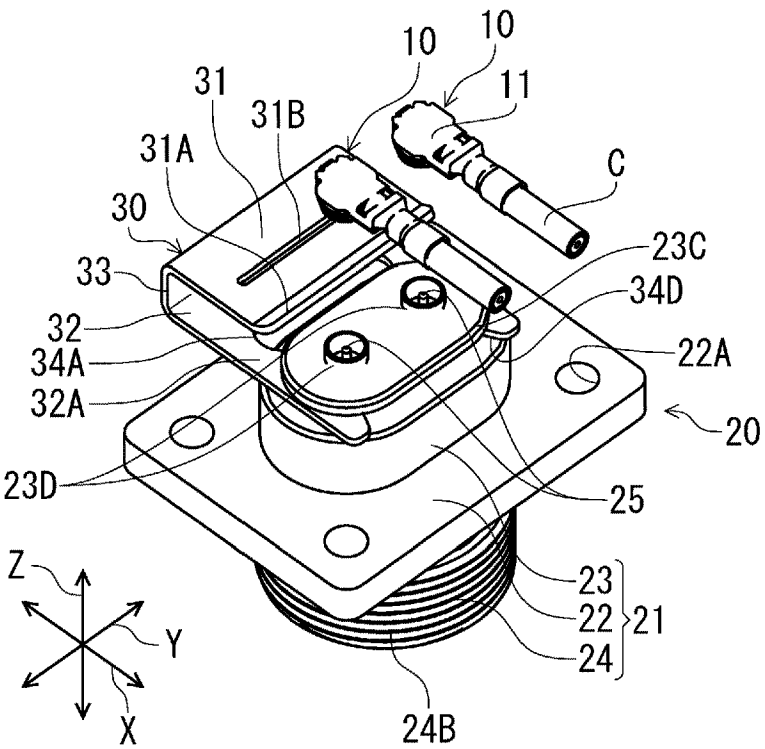
Figure 11B:
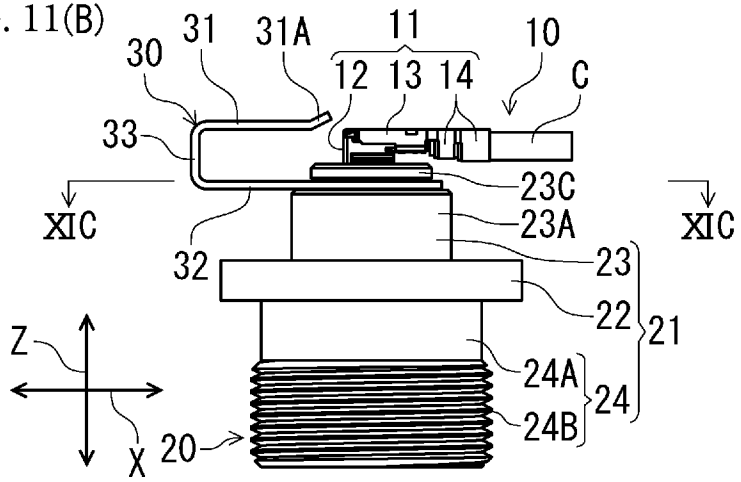
Figure 11C:
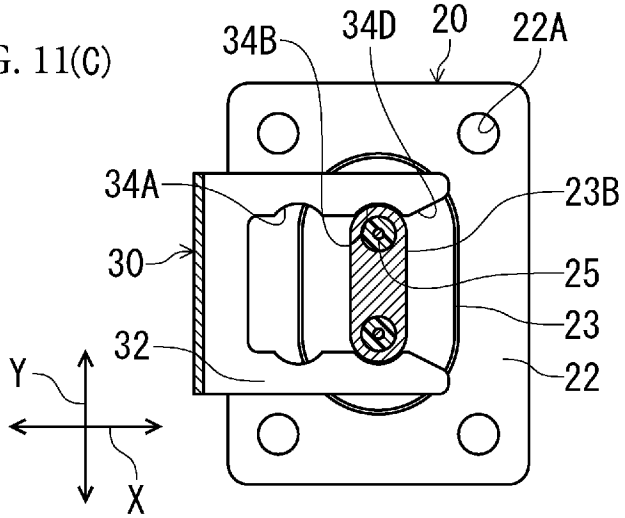
Figure 11A:
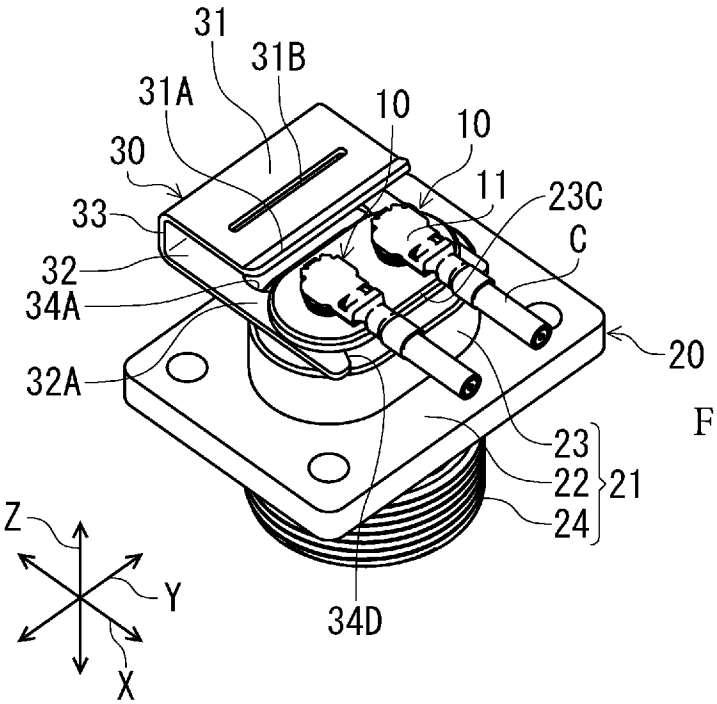
Figure 12B:
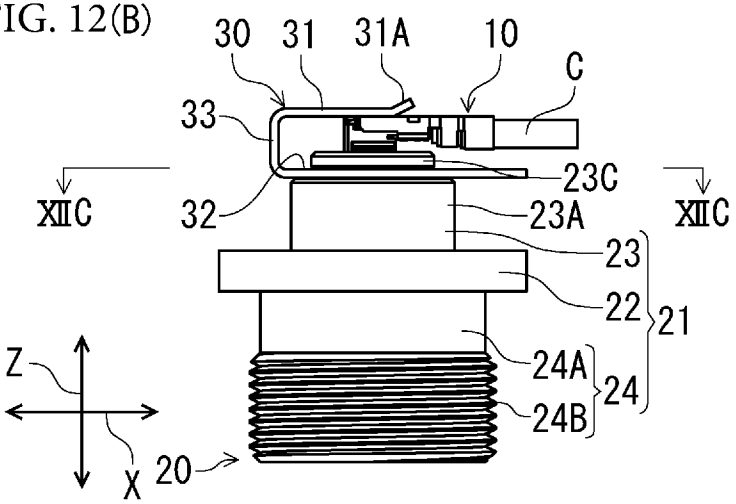
Figure 12C:
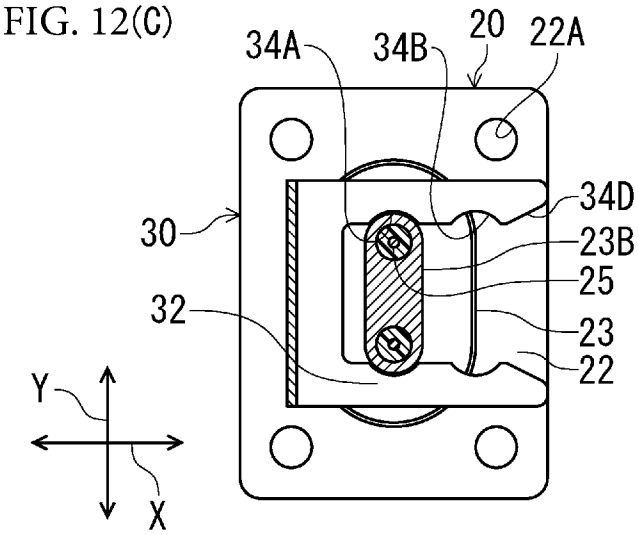
Figure 12A:
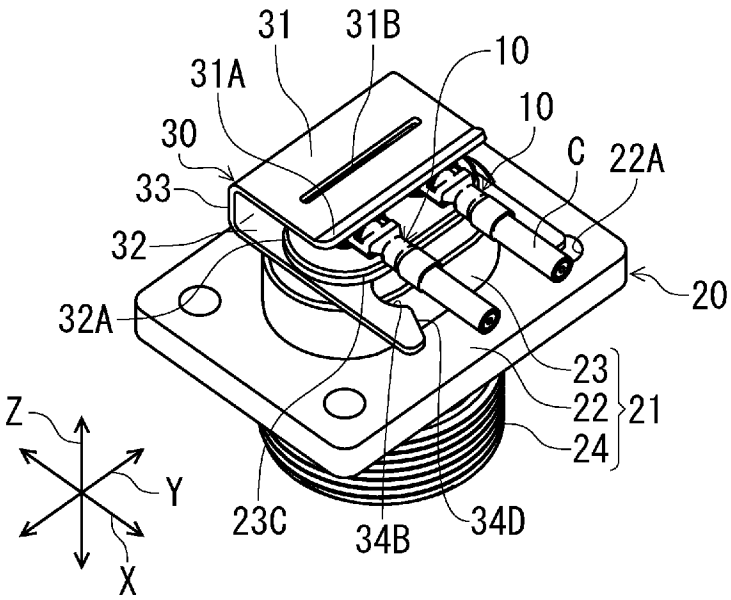

As can be seen in FIGS. 5(B) and 5(C), in the second embodiment, the peripheral surface of the intermediate portion 23'B, which forms the bottom of the mounting groove 23E in the receptacle connector 20, has formed therein a pair of parallel rectilinear portions 23'B-1 that extend in a rectilinear manner in the forward-backward direction X.

While in the first embodiment, the pair of arm portions 32A provided in the bottom portion of the locking slider 30 serving as an intermediate member had a planar shape parallel to the major faces of the flange portion 22 of the receptacle connector 20, in the second embodiment, the arm portions 32'A have horizontal arm portions 32'A-1 of a planar shape parallel to the major faces of the flange portion 22 and upright arm portions 32'A-2 rising from the outer edges of said horizontal arm portions 32'A-1 such that their cross-sectional shape in a plane perpendicular to the forward-backward direction X is substantially L-shaped, which improves strength. The horizontal arm portions 32'A-1 enter the mounting groove 23'E of the receptacle connector 20, but the inner edges of these horizontal arm portions 32'A-1 opposed in the connector width direction Y extend in the forward-backward direction X in a linear configuration, whereby the front engaging portions 34A, rear engaging portions 34B, and narrowing portions 34C of the first embodiment are not formed, and only sloping lead-in portions 34'D are formed on rear end side. In the present embodiment, the distance between the two opposite inner edges of the pair of horizontal arm portions 32'A-1 is substantially equal to the distance between the two parallel rectilinear portions 23'B-1 formed in the intermediate portion 23'B of the receptacle connector 20.

On the other hand, the pair of upright arm portions 32'A-2 are provided with engagement protrusions 34'F curved so as to locally protrude in mutually opposed inboard directions. Said engagement protrusions 34'F, which are formed in the insertion/removal direction Z within a range that includes the elevation range of the annular protrusion 23C of the receptacle connector 20, are located forward of the center where the inner conductor 25 of the receptacle connector 20 is located, in the forward-backward direction X, when the locking slider 30 is at the open position illustrated in FIGS. 6(A) to 6(C), and rearward of the center where the inner conductor 25 is located when the locking slider 30 is at the locked position illustrated in FIGS. 8 (A) to 8(C). Specifically, they pass the location of the inner conductor 25 in the forward-backward direction X in the process of movement during which the locking slider 30 is maneuvered from the open position to the locked position.

Thus, in the second embodiment, the horizontal arm portions 32'A-1 are guided within the mounting groove 23'E of the receptacle connector 20 in the forward-backward direction X and the open and locked positions are defined using the engagement protrusions 34'F of the upright arm portions 32'A-2.

Third Embodiment

Next, a connector assembly used in a third embodiment of the present invention is shown in FIGS. 9(A) to 12(C). FIGS. 9(A) to 12(C) show a plug connector serving as a first connector, a receptacle connector serving as a second connector, and a locking slider serving as an intermediate member successively transitioning from a separated state to a state wherein the locking slider has been moved to the locked position after mating the plug connector with the receptacle connector, and in each of the figures, FIGS. 9(A), 10(A), 11(A), and 12(A) are perspective views, FIGS. 9(B), 10(B), 11(B) and 12(B) illustrate lateral views, and FIGS. 9(C), 10(C), 11(C), and 12(C) illustrate cross-section views taken at the location of the mounting groove of the receptacle connector, which is similar to the first embodiment illustrated in FIGS. 1(A) to 4(C) and the second embodiment illustrated in FIGS. 5(A) to 8(C). It is to be noted that in FIGS. 9(A) to 12(C), which illustrate the third embodiment, parts in common with FIGS. 1(A) to 4(C), which illustrate the first embodiment, and with FIGS. 5(A) to 8(C), which illustrate the second embodiment, are designated with like reference numerals and their discussion is omitted.

While the third embodiment is basically similar to the first embodiment, it is different from the first embodiment in that the receptacle connector 20 is a dual-fiber coaxial connector having two inner conductors 25 at spaced-apart locations, a single-fiber plug connector 10 similar to that of the first embodiment is connected respectively to each inner conductor 25, and there is a provided a locking slider 30 serving as an intermediate member that corresponds to the receptacle connector 20.

In the third embodiment, the upper body portion 23 in the outer conductor 21 of the receptacle connector 20 has an elliptical shape elongated in the connector width direction Y, in other words, the upper base portion 23A, intermediate portion 23B, annular protrusion 23C, and mounting groove 23E are elliptical in shape. The mating portions 23D are adapted to protrude relative to the annular protrusion 23C in the same configuration as in the first embodiment at two locations spaced apart in the connector width direction Y and have a single-fiber plug connector 10 connected to each of the mating portions 23D.

On the other hand, while the locking slider 30 serving as an intermediate member is similar to the one in the first embodiment, the pair of arm portions 32A, in which the distance between the two arm portions 32A is made wider than in the first embodiment, are adapted to engage the mounting groove 23E of said elliptical shape elongated in the connector width direction Y at both ends of said mounting groove 23E in the longitudinal direction.

The present invention is not limited to Embodiments 1 to 3 that have been illustrated and described above and can be modified. Although in Embodiments 1 to 3 the locking slider serving as an intermediate member was mounted directly to the receptacle connector serving as a second connector, another member mounted to the receptacle connector may be used as an intermediary member, and, by mounting the intermediate member to this intermediary member, said intermediate member may be indirectly mounted to the receptacle connector through the medium of the intermediary member. Furthermore, a configuration may be used in which the first and second connectors are interchanged, in other words, the first connector may be a receptacle connector and the second connector may be a plug connector.

In the illustrated and described Embodiments 1 to 3 the locking slider, as an intermediate member, was first mounted to the receptacle connector at the open position, and then, after the plug connector serving as a first connector had been connected to the receptacle connector serving as a second connector, was brought to the locked position, such that the top portion of the locking slider prevented disengagement of the first connector. However, the present invention is not limited to these embodiments, and the locking slider may be adapted to be mounted to the receptacle connector so as to be at the locked position after the plug connector is connected to the receptacle connector. In such a case, after connecting the plug connector to the receptacle connector, the locking slider is mounted to the receptacle connector at the locked position. For this reason, there is no need to form an open position and, therefore, there is no need for the top portion to be formed shorter than the bottom portion and the length of the top portion can be configured in a discretionary manner.

Furthermore, the locking slider serving as an intermediate member can also be maneuvered in directions other than the one used in the preceding examples, in which it is enabled for operational movement in a single direction in a plane perpendicular to the insertion/removal direction Z, in other words, the plane that includes the forward-backward direction X and the connector width direction Y, for example, the forward-backward direction X. For example, when the locking slider is maneuvered in the plane perpendicular to the insertion/removal direction Z, said locking slider may move not horizontally in the forward-backward direction X, but in a manner involving rotation (pivoting) about an axis oriented in the insertion/removal direction Z. Furthermore, the locking slider may be adapted to move in the forward-backward direction X while rotating about an axis oriented in the connector width direction Y.

DESCRIPTION OF THE REFERENCE NUMERALS

10 First (plug) connector
20 Second (receptacle) connector
23E Mounting groove
30 Intermediate member (locking slider)
31 Locking portion (top portion)
32 Mountable portion (bottom portion)
32A Arm portions
34A (Front) Engaging portions
34B (Rear) Engaging portions

What is claimed is:

1. An electrical connector assembly comprising:
a first connector, to which a cable is connected;
a second connector, which is mounted to a mounting face of a support member and into or from which the first connector is inserted or removed; and
an intermediate member that prevents the first connector from disengaging from the second connector,
wherein an up-down direction perpendicular to the mounting face is the insertion/removal direction of the first connector and second connector,
wherein the intermediate member comprises a mountable portion mounted directly, or mounted indirectly through an intermediary member, to the second connector, and a locking portion that prevents upward disengagement of the first connector,
wherein upon connection of the first connector to the second connector, the intermediate member is mounted via the mountable portion to the second connector at a locked position in which disengagement of the first connector is prevented by the locking portion,
wherein an upper surface of the first connector is exposed to outside of the electrical connector assembly, and
wherein the intermediate member is configured to mutually slide between a lock position and a standby position that is in an unlocked state.

2. An electrical connector assembly comprising:
a first connector, to which a cable is connected;

a second connector, which is mounted to a mounting face of a support member and into or from which the first connector is inserted or removed; and an intermediate member that prevents the first connector from disengaging from the second connector, wherein an up-down direction perpendicular to the mounting face is the insertion/removal direction of the first and second connectors, wherein the intermediate member comprises a mountable portion mounted directly, or mounted indirectly through an intermediary member, to the second connector, and a locking portion that prevents upward disengagement of the first connector, and, while the mountable portion is mounted to the second connector, the intermediate member is enabled for operational movement relative to the second connector between an open position that allows for the insertion or removal of the first connector into or from the second connector and a locked position in which disengagement of the first connector is prevented by the locking portion, and wherein an upper surface of the first connector is exposed to outside of the electrical connector assembly.

3. The electrical connector assembly according to claim 2, wherein the intermediate member comprises a bottom portion, which forms the mountable portion, and a top portion, which forms the locking portion, and wherein one end of the bottom portion and one end of the top portion are coupled by a coupling portion, the top portion and the bottom portion extending towards other ends in a direction of operational movement of the intermediate member, and, at the open position, the top portion forms an insertion/removal space that permits the insertion or removal of the first connector.

4. The electrical connector assembly according to claim 3, wherein the top portion of the insertion/removal space of the intermediate member is formed to be shorter than the bottom portion in the direction of operational movement.

5. The electrical connector assembly according to claim 2, wherein the mountable portion of the intermediate member comprises two arm portions extending in the direction of operational movement, the second connector comprises a mounting groove in which the arm portions of the mountable portion of the intermediate member are mounted to the second connector by moving in the direction of operational movement, and wherein said mounting groove, while making the operational movement of the intermediate member possible, allows the two arm portions to engage the second connector in the up-down direction within the mounting groove.

6. The electrical connector assembly according to claim 5, wherein mutually opposed inner edges of the two arm portions extend in a rectilinear manner in the direction of operational movement, the mounting groove comprises an interior groove surface extending in a rectilinear manner in the direction of operational movement along the inner edges of the two arm portions, and the inner edges of the two arm portions are abuttable against an interior groove surface of the mounting groove.

7. The electrical connector assembly according to claim 5, wherein the two arm portions have engaging portions for positioning in the direction of operational movement by engaging the second connector at the open position or at the locked position.

8. The electrical connector assembly according to claim 2, wherein the intermediate member includes a curved metal sheet member.

9. The electrical connector assembly according to claim 2, wherein the cable of the first connector extends in a direction parallel to the mounting face.

10. The electrical connector assembly according to claim 9, wherein the cable connected to the first connector extends from the first connector from one end towards an other end of the intermediate member.

11. The electrical connector assembly according to claim 2, wherein the cable includes a coaxial cable, and the first and second connectors include coaxial connectors.

12. The electrical connector assembly according to claim 2, wherein the electrical connector assembly is part of an electronic device comprising a support member to which the second connector in said electrical connector assembly is mounted directly or through an intermediary member, said support member including a circuit board or a housing in the electronic device.

13. The electrical connector assembly according to claim 1, wherein an entirety of the upper surface of the first connector is exposed to the outside of the electrical connector assembly.

14. The electrical connector assembly according to claim 1, wherein, in the up-down direction, an entirety of the upper surface of the first connector is spaced apart from the intermediate member.

15. An electrical connector assembly comprising:

a first connector, to which a cable is connected;

a second connector, which is mounted to a mounting face of a support member and into or from which the first connector is inserted or removed; and an intermediate member that prevents the first connector from disengaging from the second connector, wherein an up-down direction perpendicular to the mounting face is the insertion/removal direction of the first and second connectors, wherein the intermediate member comprises a mountable portion mounted directly, or mounted indirectly through an intermediary member, to the second connector, and a locking portion that prevents upward disengagement of the first connector, and, while the mountable portion is mounted to the second connector, the intermediate member is enabled for operational movement relative to the second connector between an open position that allows for the insertion or removal of the first connector into or from the second connector and a locked position in which disengagement of the first connector is prevented by the locking portion, wherein the intermediate member comprises a bottom portion, which forms the mountable portion, and a top portion, which forms the locking portion, and wherein one end of the bottom portion and one end of the top portion are coupled by a coupling portion, the top portion and the bottom portion extending towards other ends in a direction of operational movement of the intermediate member, and, at the open position, the top portion forms an insertion/removal space that permits the insertion or removal of the first connector.

* * * * *